US009608370B1

(12) United States Patent
Hu et al.

(10) Patent No.: US 9,608,370 B1
(45) Date of Patent: Mar. 28, 2017

(54) CONNECTOR TERMINAL

(71) Applicant: Cheng Uei Precision Industry Co., Ltd., New Taipei (TW)

(72) Inventors: Xing-Yu Hu, Dong-Guan (CN); Gao-Hua Du, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/185,005

(22) Filed: Jun. 16, 2016

(51) Int. Cl.

| | |
|---|---|
| ***H01R 13/44*** | (2006.01) |
| ***H01R 13/631*** | (2006.01) |
| ***H01R 13/405*** | (2006.01) |
| ***H01R 13/6597*** | (2011.01) |
| ***H01R 43/02*** | (2006.01) |
| ***H01R 43/16*** | (2006.01) |

(52) U.S. Cl.
CPC ..... *H01R 13/631* (2013.01); *H01R 13/405* (2013.01); *H01R 13/6597* (2013.01); *H01R 43/0214* (2013.01); *H01R 43/16* (2013.01)

(58) Field of Classification Search
CPC ..... H01R 13/4534; H01R 13/4536; H01R 13/631; H01R 13/639; H01R 13/2442
USPC ..... 439/137, 138, 862, 374, 385
See application file for complete search history.

(56) References Cited

U.S. PATENT DOCUMENTS

| | | | | |
|---|---|---|---|---|
| 5,315,478 | A * | 5/1994 | Cadwell | G06F 1/1613 361/679.32 |
| 7,402,068 | B1 * | 7/2008 | Tarchinski | B60L 3/0069 439/350 |
| 7,459,631 | B2 * | 12/2008 | Nakayama | H05K 5/0204 174/50 |
| 7,486,523 | B2 * | 2/2009 | Wu | H05K 7/1431 361/740 |

* cited by examiner

*Primary Examiner* — Phuongchi T Nguyen
(74) *Attorney, Agent, or Firm* — Cheng-Ju Chiang

(57) ABSTRACT

A connector terminal includes a holding portion, an elastic arm portion connected to a front end of the holding portion. The holding portion and the elastic arm portion as a whole show an outward arc shape, a front end of the elastic arm portion protrudes inward to form a contact portion, a rear end of the holding portion is bent and extended inward and then extended rearward to form an abutting portion, the thickness of the holding portion and the elastic arm portion becomes gradually smaller from the holding portion to the front end of the elastic arm portion.

7 Claims, 4 Drawing Sheets

CONNECTOR TERMINAL

BACKGROUND OF THE INVENTION

1. Field of the Invention

The present invention relates to a connector, and more particularly to a connector terminal.

2. The Related Art

The current connector terminal has a holding portion, an elastic portion which is connected with one end of the holding portion, a contact portion which is connected with a distal end of the elastic portion, and a soldering portion which is connected with the other end of the holding portion. Usually, the holding portion, the contact portion, the elastic portion and the soldering portion are made of by a plate with a single thickness.

However, when the connector terminal is applied to an ultra-thin connector, the thickness of the connector terminal is fixed and thin, therefore the insertion force of the connector terminal will become smaller and the structural strength of the connector terminal will be not enough.

SUMMARY OF THE INVENTION

An object of the present invention is to provide a connector terminal. The connector terminal includes a holding portion, an elastic arm portion connected to a front end of the holding portion. The holding portion and the elastic arm portion as a whole show an outward arc shape. A front end of the elastic arm portion protrudes inward to form a contact portion. A rear end of the holding portion is bent and extended inward and then extended rearward to form an abutting portion, the thickness of the holding portion and the elastic arm portion becomes gradually smaller from the holding portion to the front end of the elastic arm portion.

Another object of the present invention is to provide a connector adapted for receiving a mating portion of a mating connector therein. The connector includes a housing, two connector terminals and a shielding shell. The two connector terminals are mounted to two opposite sides of the housing. Each of the connector terminals has a holding portion, an elastic arm portion connected to a front end of the holding portion. The holding portion and the elastic arm portion as a whole show an outward arc shape, a front end of the elastic arm portion protrudes inward to form a contact portion against one of two opposite sides of the mating portion, a rear end of the holding portion is bent and extended inward and then extended rearward to form a abutting portion, the thickness of the holding portion and the elastic arm portion becomes gradually smaller from the holding portion to the front end of the elastic arm portion. The shielding shell sleeves the housing and the two connector terminals therein, a part of the holding portion against an inner side of the shielding shell.

As described above, the thickness is gradually smaller from the holding portion to the front end of the elastic arm portion, the holding portion and the elastic arm portion as a whole show an outward arc shape, which can greatly improve the structure strength and the positive force of the connector terminal, the thickness of the contact portion is smaller than the thickness of the holding portion and the elastic arm portion to make the connector terminal having good elasticity.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
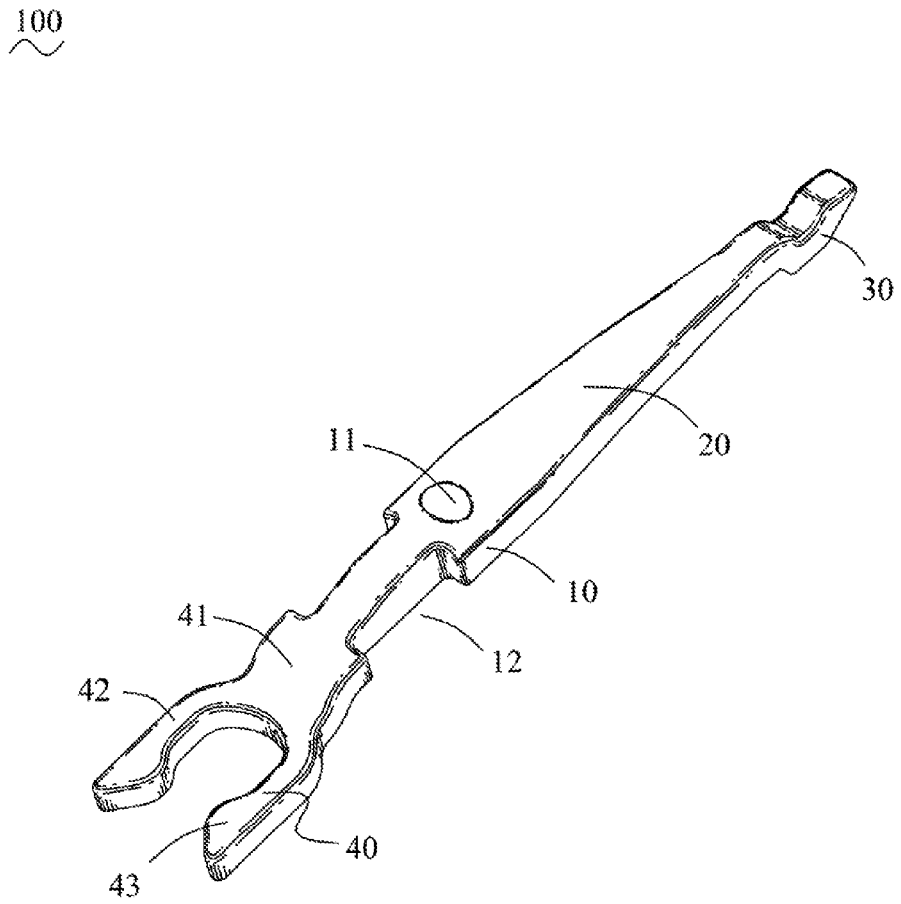
FIG. 1 is a perspective view of a connector terminal in accordance with an embodiment of the present invention.
Figure 2:
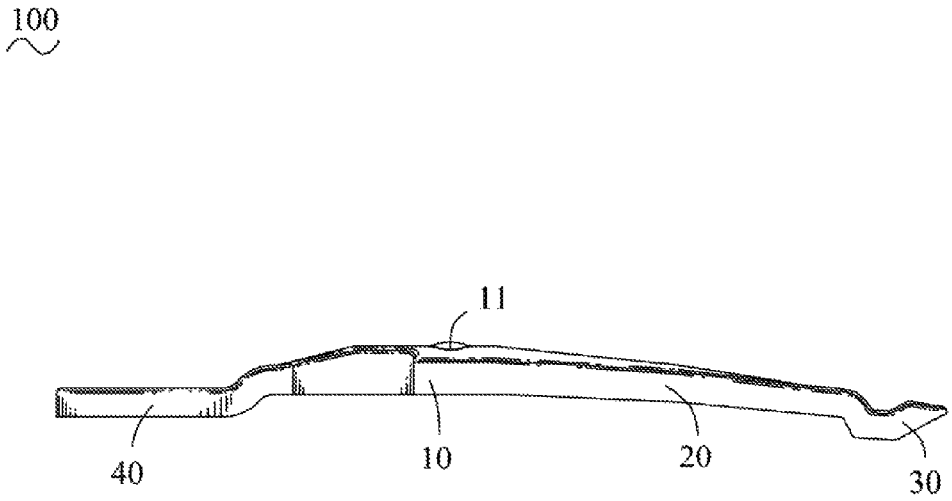
FIG. 2 is a side perspective view of the connector terminal shown in FIG. 1.
Figure 3:
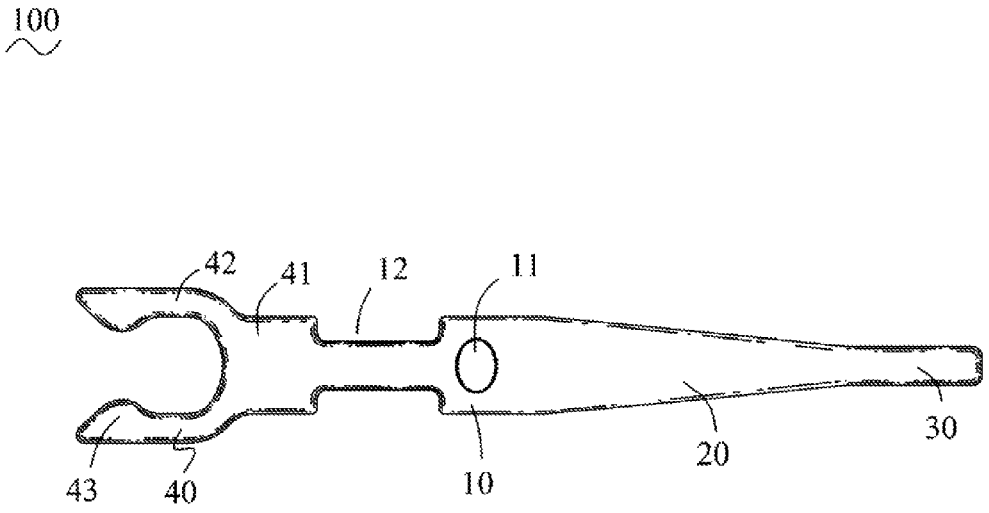
FIG. 3 is a top perspective view of the connector terminal shown in FIG. 1.
Figure 4:
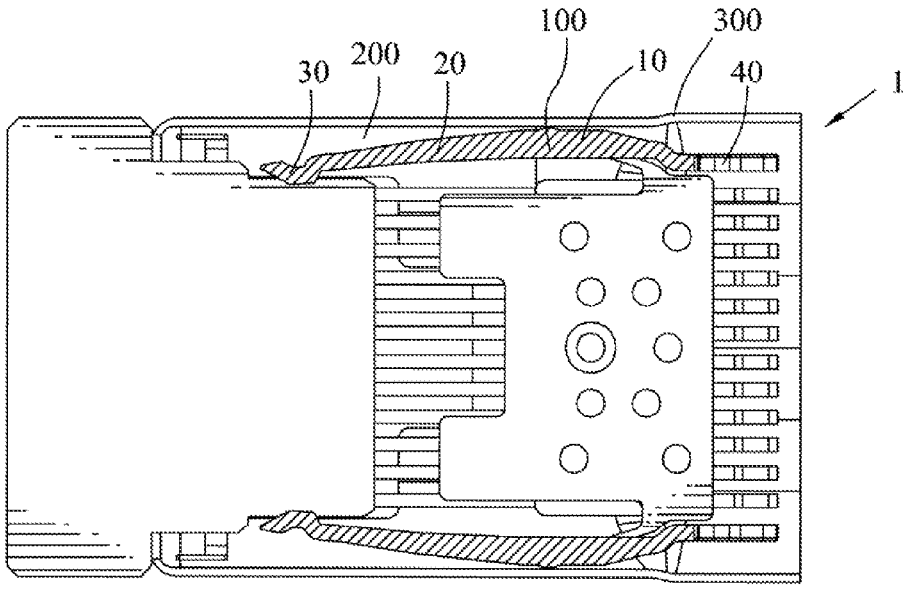
FIG. 4 is a cross-sectional perspective view showing the connector terminal shown in FIG. 1 being mounted to a connector.

With reference to FIG. 1 to FIG. 4, an embodiment of the present invention is shown as a connector terminal 100. The connector terminal 100 is an element of a connector 1. The connector 1 includes a housing 200, a shielding shell 300, two connector terminals 100 respectively mounted to two opposite sides of the housing 200, and many other elements (not labeled or shown). The shielding shell 300 sleeves the housing 200 and the two connector terminals 100 therein. The connector terminal 100 has a holding portion 10, an elastic arm portion 20 which is connected to a front end of the holding portion 10, the holding portion 10 and the elastic arm portion 20 as a whole show an outward arc shape. A front end of the elastic arm portion 20 protrudes inward to form a contact portion 30. When a mating portion of a mating connector (not shown) is inserted in the connector 1, the contact portions 30 of the two connector terminals 100 are against two opposite sides of the mating portion of the mating connector, respectively. A rear end of the holding portion 10 is bent inward and then extended rearward to form an abutting portion 40. The thickness of the holding portion 10 and the elastic arm portion 20 becomes gradually smaller from the holding portion 10 to the front end of the elastic arm portion 20.

An outer surface of the holding portion 10 protrudes a convex portion 11 for spot welding with an inner side of the shielding shell 300 of the connector 1. The convex portion 11 is located near the front end of the holding portion 10. An upper side and a lower side of the holding portion 10 define a pair of gaps 12 located between the convex portion 11 and the rear end of the holding portion 10.

The width of the holding portion 10 is greater than the width of the elastic arm portion 20, the width of the elastic arm portion 20 becomes gradually smaller from a rear end to the front end of the elastic arm portion 20.

The front end of the elastic arm portion 20 is bent inward and extended forward and then bent and extended outward to form the contact portion 30, the thickness of the contact portion 30 is smaller than the thickness of the elastic arm portion 20.

The abutting portion 40 includes a bending part 41 formed by the rear end of the holding portion 10 bending and extending inward and a substantially U shaped contact foot 42 formed by a rear end of the bending part 41 expanding upward and downward and then extending rearward, a rear end of the contact foot 42 protrudes inward to form two projections 43.

The connector terminal 100 are made by forging, the thickness is gradually smaller from the holding portion 10 to the front end of the elastic arm portion 20, the holding portion 10 and the elastic arm portion 20 as a whole show an outward arc shape, which can greatly improve the structure strength and the positive force of the connector terminal 100, the thickness of the contact portion 30 is smaller than the thickness of the holding portion 10 and the elastic arm portion 20 to make the connector terminal 100 having good elasticity.

What is claimed is:

1. A connector terminal, comprising:

a holding portion, an elastic arm portion connected to a front end of the holding portion, the holding portion and the elastic arm portion as a whole showing an outward arc shape, a front end of the elastic arm portion protruding inward to form a contact portion, a rear end of the holding portion being bent and extended inward and then extended rearward to form an abutting portion, the thickness of the holding portion and the elastic arm portion becoming gradually smaller from the holding portion to the front end of the elastic arm portion;

wherein an outer surface of the holding portion protrudes a convex portion for spot welding with the inner side of a shielding shell.

2. The connector terminal as claimed in claim 1, wherein the convex portion is located near the front end of the holding portion, an upper side and a lower side of the holding portion define a pair of gaps located between the convex portion and the rear end of the holding portion.

3. The connector terminal as claimed in claim 1, wherein the width of the elastic arm portion becomes gradually smaller from a rear end to the front end thereof.

4. The connector terminal as claimed in claim 1, wherein the front end of the elastic arm portion is bent inward and extended forward and then bent and extended outward to form the contact portion, the thickness of the contact portion is smaller than the thickness of the elastic arm portion.

5. The connector terminal as claimed in claim 1, wherein the abutting portion includes a bending part formed by the rear end of the holding portion bending and extending inward and a substantially U shaped contact foot formed by a rear end of the bending part expanding upward and downward and then extending rearward, a rear end of the contact foot protrudes inward to form two projections.

6. The connector terminal as claimed in claim 1, wherein the connector terminal is made by forging.

7. A connector adapted for receiving a mating portion of a mating connector therein, the connector comprising:

a housing;

two connector terminals mounted to two opposite sides of the housing, each of the connector terminals having a holding portion, an elastic arm portion connected to a front end of the holding portion, the holding portion and the elastic arm portion as a whole showing an outward arc shape, a front end of the elastic arm portion protruding inward to form a contact portion for being against one of two opposite sides of the mating portion, a rear end of the holding portion being bent and extended inward and then extended rearward to form an abutting portion, the thickness of the holding portion and the elastic arm portion becoming gradually smaller from the holding portion to the front end of the elastic arm portion; and a shielding shell sleeving the housing and the two connector terminals therein, a part of the holding portion against an inner side of the shielding shell;

wherein an outer surface of the holding portion protrudes a convex portion for spot welding with the inner side of a shielding shell.

* * * * *